US006367920B1

(12) United States Patent
Kanai et al.

(10) Patent No.: US 6,367,920 B1
(45) Date of Patent: Apr. 9, 2002

(54) INK CARTRIDGE FOR INK-JET RECORDING APPARATUS, AND INK-JET RECORDING APPARATUS

(75) Inventors: Masahiro Kanai; Yuichi Seki; Masanori Takemura; Akihiko Kitazawa, all of Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/754,258

(22) Filed: Jan. 5, 2001

(30) Foreign Application Priority Data

Jan. 11, 2000 (JP) ..... 12-002277

(51) Int. Cl.[7] ..... B41J 2/175
(52) U.S. Cl. ..... 347/86; 428/480
(58) Field of Search ..... 347/7, 85, 86, 347/87; 428/480, 412; 521/48; 524/569

(56) References Cited

U.S. PATENT DOCUMENTS 5,149,589 A * 9/1992 Naritomi et al. ..... 428/412
5,270,381 A * 12/1993 Yamanaka et al. ..... 524/569
5,657,058 A * 8/1997 Mochizuki et al. ..... 347/7
5,949,458 A * 9/1999 Studholme ..... 347/86

FOREIGN PATENT DOCUMENTS

JP 07207068 A * 8/1995 ..... C08L/9/02

* cited by examiner

*Primary Examiner*—N. Le
*Assistant Examiner*—Anh T. N. Vo
(74) *Attorney, Agent, or Firm*—Sughrue Mion, PLLC

(57) ABSTRACT

An ink cartridge for an ink-jet recording apparatus including an ink supply opening having a packing member capable of closely contacting with the outer circumference of an ink supply needle, the packing member is made of a thermoplastic elastomer containing 25% or less by weight of a polyethylene oil.

14 Claims, 4 Drawing Sheets

INK CARTRIDGE FOR INK-JET RECORDING APPARATUS, AND INK-JET RECORDING APPARATUS

BACKGROUND OF THE INVENTION

The present invention relates to an ink cartridge for an ink-jet recording apparatus, and an ink-jet recording apparatus. More specifically, the present invention relates to an ink cartridge provided with an ink supply opening having a packing member, and an ink-jet recording apparatus having the ink cartridge.

Since a graphic process can be executed relatively easily owing to development of personal computers, a recording apparatus has been required, which can output a high quality hard copy of, for example, a color image shown on a display. In order to respond to such a demand, a recording apparatus mounting an ink-jet recording head thereon has been provided.

Since the ink-jet recording apparatus is relatively small in printing noise and can form small dots at a high density, the ink-jet recording apparatus is used for many kinds of printing including color printing.

For ink supply to a recording head in the ink-jet recording apparatus during printing and recording, an ink supply needle communicating with the recording head for ejecting ink is inserted into an ink supply opening of an ink cartridge for an ink-jet recording apparatus so that the ink in the ink cartridge is sent to the recording head via the ink supply needle. In order to prevent problems, such as drying of the ink by the contact with the outside air and introduction of air bubbles in the ink, the ink supply needle is formed using an olefin based amorphous polymer high in molding property and extremely low in gas permeability, while the ink supply opening is provided with a packing member closely contactable with the outer circumference of the ink supply needle, thereby securing the sealing property of an ink channel. Since ink replenishment is executed by replacing ink cartridges, the ink supply opening of the ink cartridge and the ink supply needle should be attached or detached easily. For this reason, a butyl rubber is widely used as a material of the packing member.

However, the butyl rubber is not always stable with respect to various kinds of ink, and thus the butyl rubber may cause an unsatisfactory result when used in combination with certain kinds of ink. Moreover, since molding of the butyl rubber is accomplished, in general, by a compression molding method, the dimensional accuracy is unstable due to irregularity of the material thickness. Therefore, in practice, finish inspection for all of products is required to ensuring the product quality.

As a material to be adopted in place of the butyl rubber having the aforementioned disadvantage, a thermoplastic elastomer is conceivable, which exhibits rubber elasticity in an ordinary temperature but plastic and moldable property by application of heat. The thermoplastic elastomer is high in stability with respect to ink, and also high in dimensional accuracy because the thermoplastic elastomer can be molded using an ordinary injection molding method.

However, in the case such a thermoplastic elastomer is used for a packing member in an ink supply opening of an ink cartridge for an ink-jet recording apparatus, and the packing member is closely contacted with an ink supply needle by inserting the ink supply needle into the ink supply opening, the ink supply needle made, in particular, of an olefin based amorphous polymer is deformed after a certain time so that it is difficult to pull out the ink supply needle from the ink supply opening of the ink cartridge as well as to insert the ink supply needle into an ink supply opening of a new ink cartridge. This will cause a malfunction of the ink-jet recording apparatus.

SUMMARY OF THE INVENTION

In view of the above-mentioned problems, the invention has been achieved, and an object thereof is to provide an ink cartridge, adapted for an ink-jet recording apparatus, which comprises an ink supply opening having a packing member high in corrosion resistance with respect to various kinds of inks, stable in molding process accuracy, and free from the risk of causing a malfunction of the ink-jet recording apparatus. Another object of the present invention is to provide an ink-jet recording apparatus having such ink cartridge.

As a result of elaborate experiments by the present inventors, it was found out that the above-mentioned object can be achieved by adjusting the amount of a polyethylene oil to be added generally to a thermoplastic elastomer for obtaining an appropriate flowability required at the time of molding, and an appropriate rubber hardness of a member required after molding. That is, the technological configuration and the effects of the invention are as follows.

An ink cartridge for an ink-jet recording apparatus according to a first aspect comprises an ink supply opening having a packing member capable of closely contacting with the outer circumference of an ink supply needle provided in an ink-jet recording apparatus main body, wherein the packing member is made of a thermoplastic elastomer containing 25% or less by weight of a polyethylene oil. Since the packing member is made of a thermoplastic elastomer, a packing member with a high corrosion resistance with respect to various kinds of inks, and a stable molding process accuracy can be provided. Moreover, since the thermoplastic elastomer contains 25% or less by weight of a polyethylene oil, in the case of inserting an olefin based amorphous polymer ink supply needle in an ink supply opening, the packing member can hardly degrade the quality of the olefin based amorphous polymer ink supply needle. Therefore, an ink cartridge for an ink-jet recording apparatus comprising an ink supply opening having a packing member without the risk of causing a malfunction of the ink-jet recording apparatus can be provided.

In the ink cartridge for an ink-jet recording apparatus according to a second aspect, the rubber hardness of the thermoplastic elastomer is 40 to 70 (Shore hardness). Accordingly, the packing member and the ink supply needle can be contacted particularly closely so that the sealing property of the ink channel can be maintained further certainly. Therefore, an ink cartridge for an ink-jet recording apparatus capable of preventing problems such as drying of the ink by the contact with the outside air, and introduction of bubbles can be provided.

In the ink cartridge for an ink-jet recording apparatus according to a third aspect, the packing member comprises a contact tongue piece tilingly protruded into an interior of the packing member so as to contact with the outer circumferential surface of the ink supply needle. The contact tongue piece can easily be deformed elastically so that stable contact with the ink supply needle can be ensured by tolerating, for example, size displacement in mounting. Therefore, an ink cartridge for an ink-jet recording apparatus capable of preventing problems such as drying of the ink by the contact with the outside air, and introduction of bubbles can be provided.

An ink-jet recording apparatus according to a fourth aspect comprises an ink supply needle communicating with an ink-jet recording head, wherein an ink supply opening of an ink cartridge for an ink-jet recording apparatus is closely contacted with the ink supply needle via a packing member, which is made of a thermoplastic elastomer containing 25% or less by weight of a polyethylene oil. Since the packing member is made of a thermoplastic elastomer, a high corrosion resistance with respect to various kinds of inks can be provided to the packing member, and a molding process accuracy of the packing member can be stabilized. Moreover, since the thermoplastic elastomer contains 25% or less by weight of a polyethylene oil, in the case of inserting an olefin based amorphous polymer ink supply needle in an ink supply opening, the packing member can hardly deform the olefin based amorphous polymer ink supply needle. Therefore, an ink-jet recording apparatus with an ink supply opening of an ink cartridge for an ink-jet recording apparatus closely contacted via a packing member without the risk of causing a malfunction of the ink-jet recording apparatus can be provided.

In the ink-jet recording apparatus according to a fifth aspect, the rubber hardness of the thermoplastic elastomer is 40 to 70 (Shore hardness) . Accordingly, the packing member and the ink supply needle can be contacted particularly closely so that the sealing property of the ink channel can be maintained further certainly. Therefore, an ink-jet recording apparatus capable of preventing problems such as drying of the ink by the contact with the outside air, and introduction of bubbles can be provided.

In the ink-jet recording apparatus according to a sixth aspect, the packing member comprises a contact tongue piece tiltingly protruded into an intetior of the packing member so as to contact with the outer circumferential surface of the ink supply needle. The contact tongue piece can easily be deformed elastically so that stable contact with the ink supply needle can be ensured by tolerating, for example, size displacement in mounting. Therefore, an ink-jet recording apparatus capable of preventing problems such as drying of the ink by the contact with the outside air, and introduction of bubbles can be provided.

The present disclosure relates to the subject matter contained in Japanese patent application No. 2000-2277 (filed on Jan. 11, 2000), which is expressly incorporated herein by reference in its entirety.

FIG. is a cross-sectional view showing the ink-jet recording apparatus and the ink cartridge.

Figure 3:
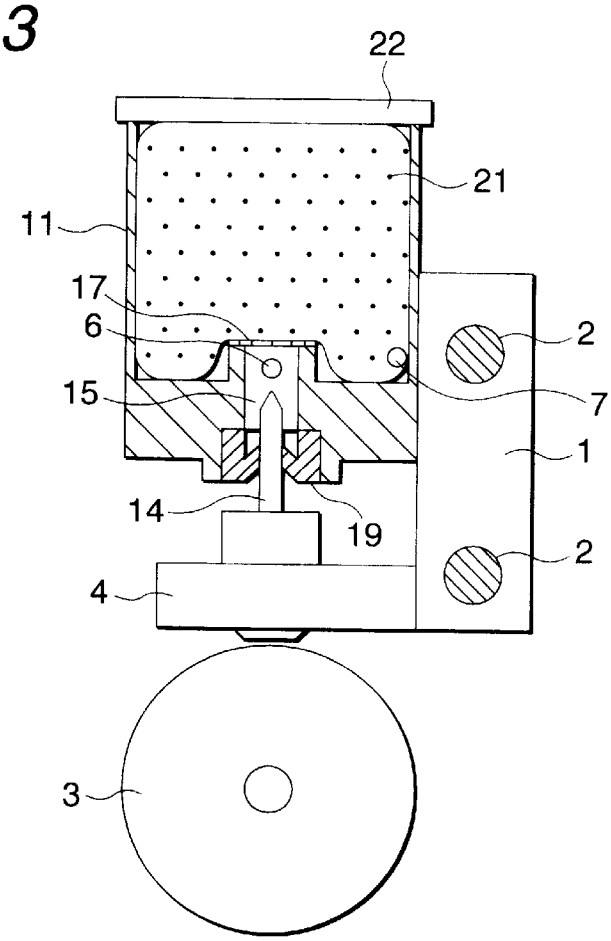
Figure 4:
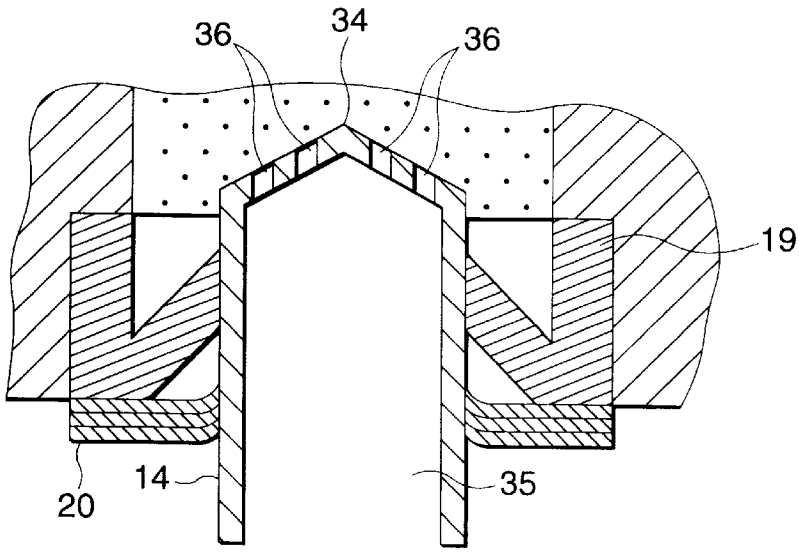

FIG. 4 is a principal part enlarged view of FIG. 3.

Figure 5:
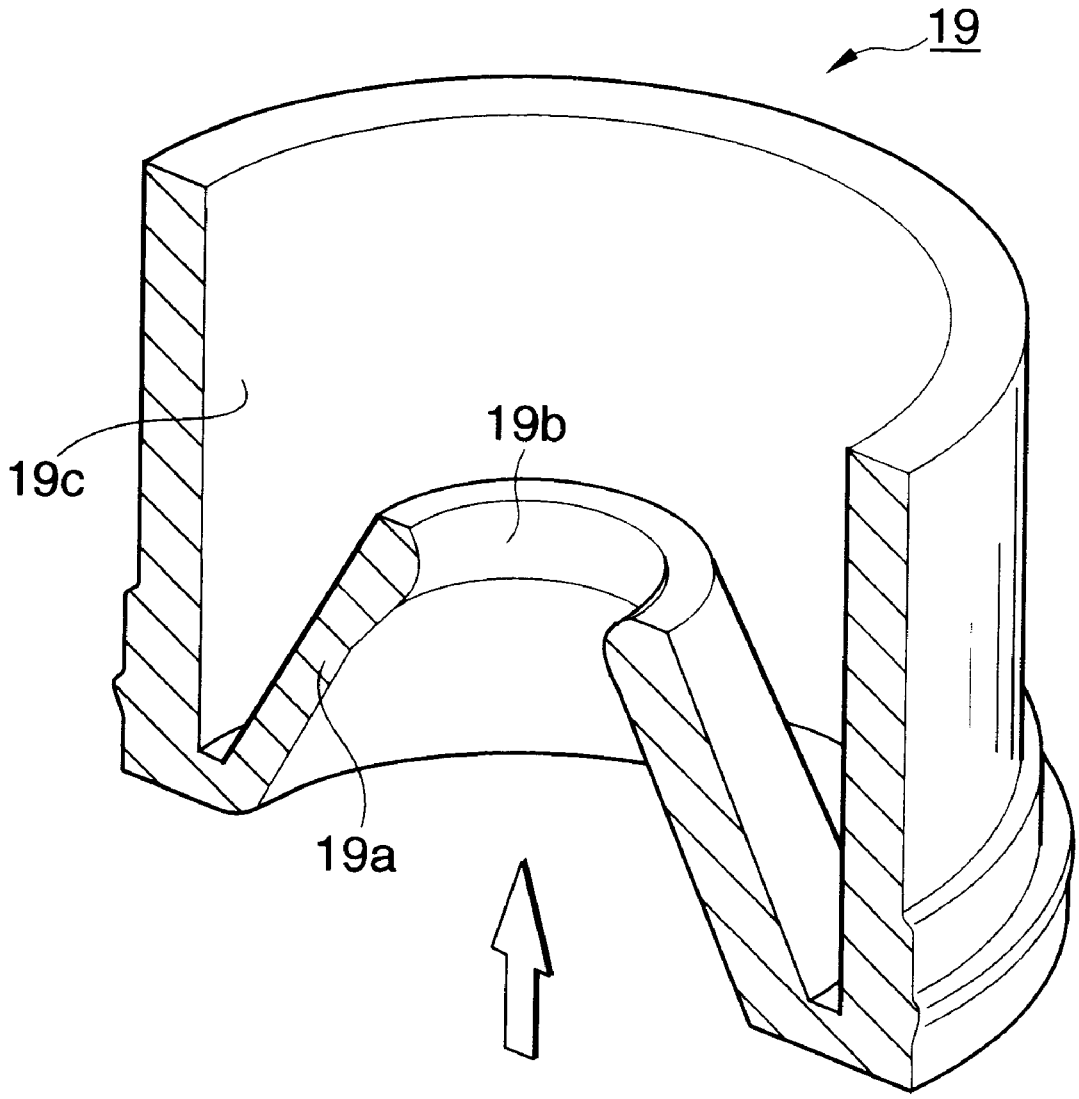

FIG. 5 is a cross-sectional perspective view showing a packing member provided in an ink supply opening of the ink cartridge.

Figure 6:
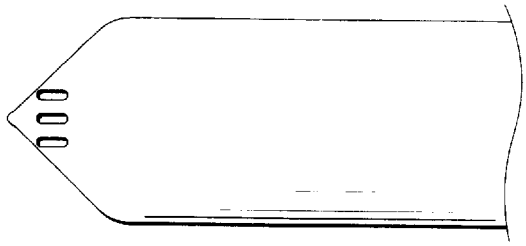

FIG. 6 is a state diagram of an ink supply needle before an ink cartridge mounting-leaving test.

Figure 7:
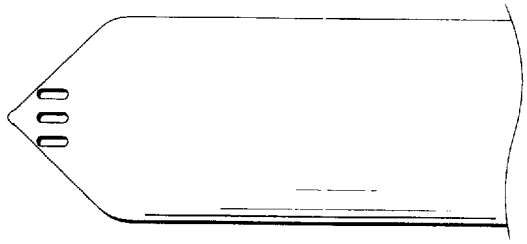

FIG. 7 is a state diagram of an ink supply needle after the ink car ridge mounting-leaving test (60° C., three days) using the packing member obtained in the example 1.

Figure 8:
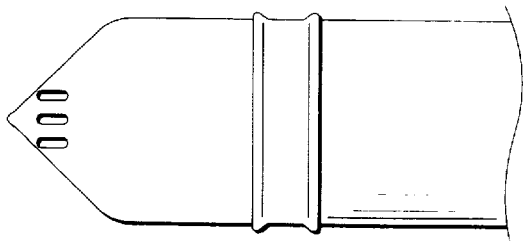

FIG. 8 is a state diagram of an ink supply needle after the ink cartridge mounting-leaving test (60° C., three days) using the packing member obtained in the comparative example 1.

Figure 9:
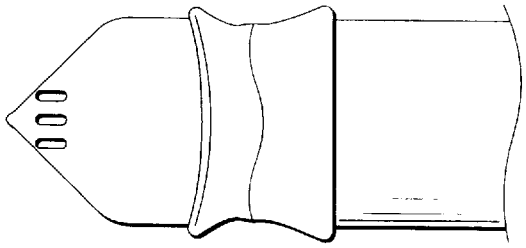

FIG. 9 is a state diagram of an ink supply needle after the ink cartridge mounting-leaving test (70° C., three days) using the packing member obtained in the comparative example 1.

DESCRIPTION OF THE PREFERRED EMBODIMENT

Hereinafter, an embodiment according to the invention will be described. However, the invention is not limited to the embodiment, but can be modified as desired without departing from the spirit and the scope of the invention.

Figure 2:
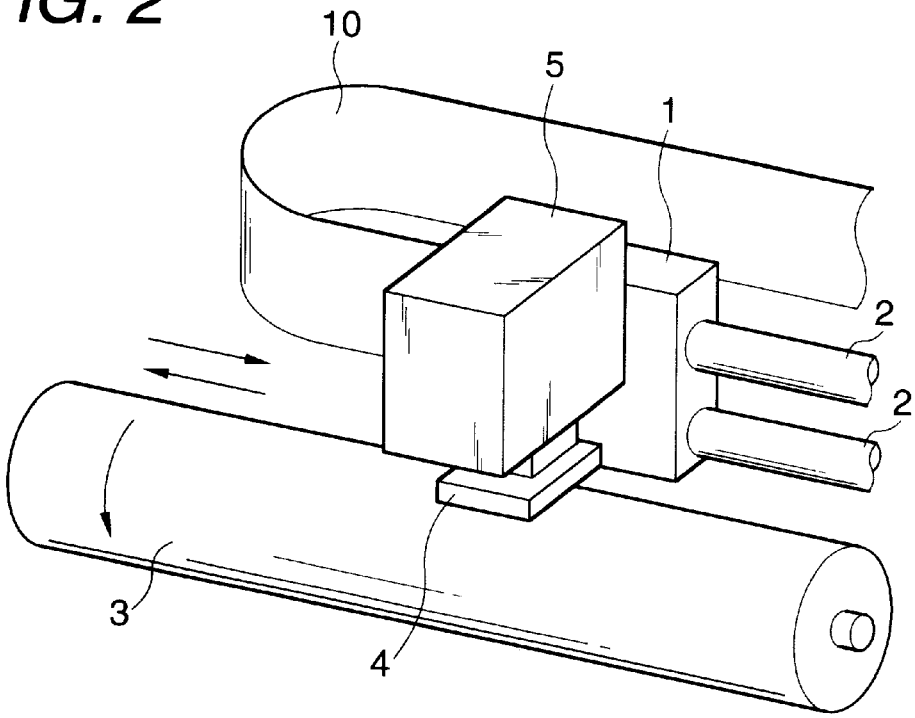
FIG. 2. is a schematic diagram showing an ink-jet recording apparatus in which the ink cartridge is installed.

FIG. 2 is a schematic diagram of an embodiment of an ink-jet recording apparatus including an ink cartridge for an ink-jet recording apparatus according to the invention. A carriage 1 is provided on guides 2, 2 reciprocally movably in the axial direction of a platen 3. The carriage 1 is provided with an ink-jet recording head 4 for ejecting ink droplets in response to a printing signal, and an ink cartridge 5 for an ink-jet recording apparatus (hereinafter also referred to simply as an ink cartridge) for supplying an ink thereto. A cable 10 serves for transmitting a printing signal to the ink-jet recording head 4.

Figure 1:
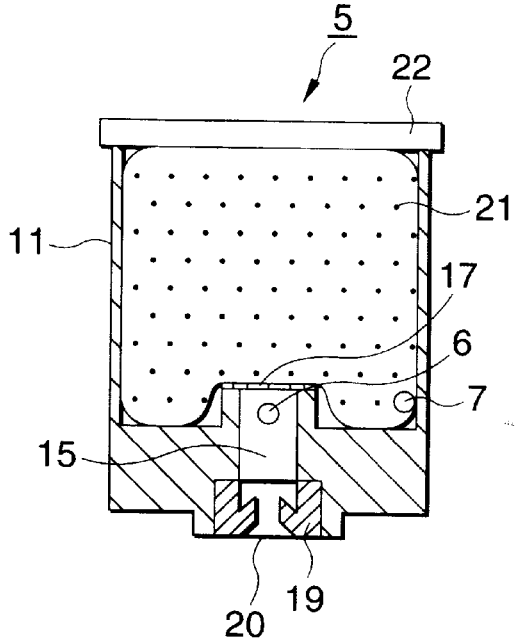
FIG. 1 is a cross-sectional view showing an ink cartridge for an ink-jet recording apparatus according to an embodiment of the invention.

More specifically, as shown in FIG. 1, the ink cartridge 5 according to the embodiment of the invention is designed such that an ink supply opening 15 is provided integrally to a bottom of a container 11 forming an ink cartridge 5 main body. A lid 22 is provided on the upper part of the container 11. A filter 17 made of a polymer material, an corrosion resistive metal, or the like, of about a 20 to 100 $\mu$m mesh size is welded and fixed to the ink supply opening 15 projecting inward of the ink container 11. A packing member 19 capable of closely contacting with the outer circumference of an ink supply needle is provided on the tip end opening side of the ink supply opening 15. As a sealing member 20 with a high airtight property, capable of allowing an easy piercing operation of an ink supply needle without the risk of breakage by an external force such as contact, for example, a polymer film, a film with a metal layer laminated on a polymer film, or the like, is welded on the ink supply opening 15.

A porous member 21 for keeping ink, produced so as to have a cross-section slightly larger than that of the container 11, is stored in the container 11 with the lower end part elastically contacting with the filter 17 of the ink supply opening 15, and the periphery of the porous member 21 pressured by the side wall of the container 11.

Electrodes 6, 7 are provided for detecting the state in which the ink of the ink cartridge 5 exists only in the ink supply opening 15, that is, the so-called ink near end state. One of them is provided at the bottom part of the container 11, and the other at the ink supply opening 15. These electrodes 6, 7 are employed for outputting a signal when the ink in the porous member 21 gets short so that the entire ink residual amount is drastically getting short.

As shown in FIG. 3, the ink-jet recording apparatus according to the embodiment of the invention can be obtained by pushing an ink supply needle 14 communicating with the ink-jet recording head 4 into the ink supply opening 15 of the ink cartridge 5 with the above-mentioned configuration. In this process, the ink supply needle 14 reaches at the packing member 19 through the sealing member 20. Accordingly, the tip end part of the ink supply needle 14 can be in the fluid-tight state with the ink supply opening 15 via the packing member 19 so as to communicate with the ink in the ink supply opening 15. At the time of inserting the ink supply needle 14 through the sealing member 20, the sealing member 20 is deformed owing to its elasticity along the tip end shape of the ink supply needle 14 as much as possible so as to prevent introduction of air.

An ink-jet recording apparatus according to the embodiment of the invention can be an ink-jet recording apparatus having the ink supply needle 14 communicating with the ink-jet recording head 4, wherein the ink supply opening 15 of the ink cartridge 5 is consequently closely contacted with the ink supply needle 14 via the packing member 19. Therefore, the packing member 19 needs not always be provided preliminarily on the ink supply opening 15 of the ink cartridge 5. That is, an ink-jet recording apparatus according to the invention can also be obtained such that the ink cartridge 5 is mounted on the ink supply needle 14 having the packing member 19 preliminarily provided thereon, or the packing member 19 is newly added at the time of mounting the ink cartridge 5 on the ink supply needle 14.

As shown in FIG. 4, the ink supply needle 14 to cooperate with the cartridge has a conical tip end shape, with a plurality of through holes 36, 36, 36, 36 formed on the tip end surface 34 thereof to connect the ink in the cartridge to a supply path 35. Accordingly, the ink in the porous member 21 reaches the ink-jet recording head 4 via the filter 17, the ink supply opening 15, the through holes 36 of the ink supply needle 14, and the supply path 35 so as to be finally used for printing.

An ink cartridge for an ink-jet recording apparatus according to the embodiment of the invention is the ink cartridge 5 for an ink-jet recording apparatus with the above-mentioned configuration, wherein the packing member 19 is made of a thermoplastic elastomer. Since the thermoplastic elastomer has a high corrosion resistance with respect to various kinds of inks, and can be molded by an ordinary injection molding method, the packing member 19 with a stable size accuracy can be obtained by molding. As the thermoplastic elastomer, known materials can be used. Examples of hard polymer components include a polystyrene component, a polyethylene component, a polypropylene component, a polyester component, and a polyamide component. Examples of soft polymer components include an ethylene propylene rubber component, an ethylene butadiene rubber component, a polyester component and a polyether component.

In addition to the hard polymer component and the soft polymer component, the thermoplastic elastomer contains a polyethylene oil by 25% or less by weight, more preferably 20 to 25% by weight. Since a polyethylene oil is contained by 20% by weight or more, a flowability is given to a thermoplastic elastomer molten fluid so that the packing member 19 can be molded certainly. Furthermore, since a polyethylene oil is contained by 25% by weight or less, even in the case the olefin based amorphous polymer ink supply needle 14 to be used preferably for a high molding property and a low gas permeability is inserted in the ink supply opening 15, the packing member 19 is less likely to degrade the quality of the olefin based amorphous polymer ink supply needle 14. As the polyethylene oil, those having the viscosity in the range of 100 to 10,000 CS can be used preferably.

Moreover, the rubber hardness of the thermoplastic elastomer is preferably 39 to 71 (Shore hardness). Accordingly, the packing member 19 and the ink supply needle 14 can be contacted closely so as to maintain the sealing property of the ink channel further certainly. (If the rubber hardness is more than 71, the role as a sealing material can hardly be provided. In contrast, if it is less than 39, an automatic assembly (automatic assembly in a line) is difficult.) More specifically, the packing member 19 preferably has a contact tongue piece 19*a* tiltingly protruded into an interior of a cylindrical body part 19*c* so as to contact with the outer circumferential surface of the ink supply needle as shown in FIG. 5. Since the contact tongue piece 19*a* has a thick contact part 19*b* on the upper end side, and an appropriate length, the contact tongue piece 19*a* can easily be deformed elastically when the ink supply needle 14 is inserted in the arrow direction in FIG. 5. This ensures, for example, stable contact with the ink supply needle 14 by tolerating size displacement in mounting.

The packing member is not limited to those having a shape shown in FIG. 5, but can have any shape, such as an O ring-like shape, as long as the object of the invention can be achieved.

EXAMPLE

The invention will be explained specifically with reference to an example of the invention, but the invention is not limited thereto.

Example 1

By molding a thermoplastic elastomer component of the below-mentioned composition, with an injection molding machine, into a shape as shown in the cross-sectional perspective view of FIG. 5, a packing member with a 40 to 70 (Shore hardness) rubber hardness was obtained.

<Composition of the thermoplastic elastomer> polypropylene 40% by weight block copolymer of polystyrene-ethylene propylene rubber-polystyrene (SEPS) 35% by weight polyethylene oil (100 to 1,000 CS) 25% by weight

Comparative Example 1

In the same molding process as in the example 1 except that the thermoplastic elastomer composition was changed to the below-mentioned composition, a packing member with a 40 to 70 (Shore hardness) rubber hardness was obtained.

<Composition of the thermoplastic elastomer> polypropylene 15% by weight block copolymer of polystyrene-ethylene propylene rubber-polystyrene (SEPS) 35% by weight polyethylene oil (100 to 1,000 CS) 50% by weight (Ink cartridge mounting-leaving test)

An olefin based amorphous polymer ink supply needle provided in an ink-jet recording apparatus (product name of Seiko Epson Corp.: PM-750C) was fitted into an ink cartridge (product name of Seiko Epson Corp.: S020093/MJIC7) having a packing member of the thermoplastic elastomer obtained each in the example 1 and the comparative example 1 from the ink supply opening of the ink cartridge so that the ink supply needle and the packing member was closely contacted with each other. After leaving in this state at 60° C. for three days, the ink cartridge was pulled out from the olefin based amorphous polymer ink supply needle of the ink-jet recording apparatus. FIG. 6 is a state diagram of the ink supply needle before the test, and FIGS. 7 and 8 are state diagrams respectively showing ink supply needles using the packing members obtained in the example 1 and the comparative example 1 after the test. Moreover, the ink cartridge mounting-leaving test was executed in the same manner with the leaving conditions at 60° C. for three days changed to at 70° C. for three days. FIG. 9 is a state diagram of the ink supply needle using the packing member obtained in the comparative example 1 after the test.

In the case the ink cartridge having the packing member obtained in the example 1 was used, after the test (leaving conditions: 60° C., three days), the ink cartridge was able to be pulled out from the ink supply needle easily. Furthermore, as shown in FIG. 7, the state of the ink supply needle was same as that of FIG. 6 so that quality degradation of the ink supply needle was not observed. Although it is not illustrated, also in the 70° C., three day leaving conditions, quality degradation of the ink supply needle was not observed after the leaving test.

In the case the ink cartridge having the packing member obtained in the comparative example 1 was used, after the test (leaving conditions: 60° C., three days), it was difficult to pull out the ink cartridge from the ink supply needle. As a result of pulling out the ink cartridge strongly, as shown in FIG. 8, quality degradation of the ink supply needle was observed. Furthermore, in the 70° C., three day leaving conditions, as shown in FIG. 9, as a result of pulling out the ink cartridge strongly, the quality of the ink supply needle was degraded remarkably.

From the results described above, it was confirmed that since the thermoplastic elastomer contains 25% or less by weight of a polyethylene oil in an ink cartridge for an ink-jet recording apparatus according to the embodiment of the invention (example 1), in the case of inserting an olefin based amorphous polymer ink supply needle in an ink supply opening, the packing member can hardly degrade the quality of the olefin based amorphous polymer ink supply needle.

According to an ink cartridge for an ink-jet recording apparatus according to the first aspect, since the packing member is made of a thermoplastic elastomer containing 25% or less by weight of a polyethylene oil in an ink cartridge for an ink-jet recording apparatus comprising an ink supply opening having a packing member capable of closely contacting with the outer circumference of an ink supply needle provided in an ink-jet recording apparatus main body, an ink cartridge for an ink-jet recording apparatus comprising an ink supply opening having a packing member with a high corrosion resistance with respect to various kinds of inks, and a stable molding process accuracy can be provided.

Moreover, since the thermoplastic elastomer contains 25% or less by weight of a polyethylene oil, the packing member can hardly degrade the quality of the olefin based amorphous polymer ink supply needle in the case of inserting an olefin based amorphous polymer ink supply needle in an ink supply opening, and thus an ink cartridge for an ink-jet recording apparatus comprising an ink supply opening having a packing member without the risk of causing a malfunction of the ink-jet recording apparatus can be provided.

According to an ink cartridge for an ink-jet recording apparatus according to the second aspect, since the rubber hardness of the thermoplastic elastomer is 40 to 70 (Shore hardness), the packing member and the ink supply needle can be contacted particularly closely so that the sealing property of the ink channel can be maintained further certainly. Therefore, an ink cartridge for an ink-jet recording apparatus capable of preventing problems such as drying of the ink by the contact with the outside air, and introduction of bubbles can be provided.

According to an ink cartridge for an ink-jet recording apparatus according to the third aspect, since the packing member comprises a contact tongue piece tiltingly protruded into the interior of the packing member so as to contact with the outer circumferential surface of the ink supply needle, owing to the easy elastic deformation of the contact tongue piece, stable contact with the ink supply needle can be ensured by tolerating, for example, size displacement in mounting. Therefore, an ink cartridge for an ink-jet recording apparatus capable of preventing problems such as drying of the ink by the contact with the outside air, and introduction of bubbles can be provided.

According to an ink cartridge for an ink-jet recording apparatus having an ink supply needle communicating with an ink-jet recording head according to the fourth aspect, since an ink supply opening of an ink cartridge for an ink-jet recording apparatus is closely contacted with the ink supply needle via a packing member, which is made of a thermoplastic elastomer containing 25% or less by weight of a polyethylene oil, an ink-jet recording apparatus comprising an ink supply needle having a packing member with a high corrosion resistance with respect to various kinds of inks and a stable molding process accuracy can be provided.

Moreover, since the thermoplastic elastomer contains 25% or less by weight of a polyethylene oil, the packing member can hardly deform the olefin based amorphous polymer ink supply needle in the case of inserting an olefin based amorphous polymer ink supply needle in an ink supply opening, and thus an ink-jet recording apparatus with an ink supply opening of an ink cartridge for an ink-jet recording apparatus closely contacted via a packing member without the risk of causing a malfunction of the ink-jet recording apparatus can be provided.

According to an ink-jet recording apparatus according to the fifth aspect, since the rubber hardness of the thermoplastic elastomer is 40 to 70 (Shore hardness), the packing member and the ink supply needle can be contacted particularly closely so that the sealing property of the ink channel can be maintained further certainly. Therefore, an ink-jet recording apparatus capable of preventing problems such as drying of the ink by the contact with the outside air, and introduction of bubbles can be provided.

According to an ink-jet recording apparatus according to a sixth aspect, since the packing member comprises a contact tongue piece tiltingly protruded into the interior of the packing member so as to contact with the outer circumferential surface of the ink supply needle, the contact tongue piece can easily be deformed elastically so that stable contact with the ink supply needle can be ensured by tolerating, for example, size displacement in mounting. Therefore, an ink-jet recording apparatus capable of preventing problems such as drying of the ink by the contact with the outside air, and introduction of bubbles can be provided.

What is claimed is:

1. An ink cartridge for an ink-jet recording apparatus, which comprises an ink supply opening having a packing member closely contactable with an outer circumference of an ink supply needle provided in an ink-jet recording apparatus main body, wherein the packing member is made of a thermoplastic elastomer containing 25% or less by weight of a polyethylene oil.

2. The ink cartridge for an ink-jet recording apparatus according to claim 1, wherein a rubber hardness of the thermoplastic elastomer is 40 to 70 in Shore hardness.

3. The ink cartridge for an ink-jet recording apparatus according to claim 1 or 2, wherein the packing member comprises a contact tongue piece tiltingly protruded into an interior of the packing member to be contactable with the outer circumferential surface of the ink supply needle.

4. An ink-jet recording apparatus comprising an ink supply needle communicating with an ink-jet recording head, wherein an ink supply opening of an ink cartridge for an ink-jet recording apparatus is closely contacted with the ink supply needle via a packing member, which is made of a thermoplastic elastomer containing 25% or less by weight of a polyethylene oil.

5. The ink-jet recording apparatus according to claim 4, wherein a rubber hardness of the thermoplastic elastomer is 40 to 70 in Shore hardness.

6. The ink-jet recording apparatus according to claim 4 or 5, wherein the packing member comprises a contact tongue piece tiltingly protruded into an interior of the packing member to be contact with the outer circumferential surface of the ink supply needle.

7. A packing member mountable to at least one of an ink supply opening and an ink supply needle to be sealingly connected together for ink supply from an ink cartridge to a recording head, the packing member essentially consisting of a thermoplastic elastomer including one or more of a polystyrene component, a polyethylene component, a polypropylene component, a polyester component, a polyamide component, an ethylene propylene rubber component, an ethylene butadiene rubber component, and a polyether component, and containing a polyethylene oil 25% or less by weight.

8. The packing member according to claim 7, wherein the thermoplastic elastomer contains the polyethylene oil 20% or more.

9. The packing member according to claim 7, wherein a rubber hardness of the thermoplastic elastomer is 39 to 71 in Shore hardness.

10. The packing member according to claim 7, wherein a viscosity of the thermoplastic elastomer is in a range of 100 to 10,000 cs.

11. The packing member according to claim 7, comprising:

a cylindrical body part having first and second ends; and a conical part extending from the first end toward the second end and located within an interior of the cylindrical body part.

12. The packing member according to claim 11, further comprising:

a contact part on an end of the conical part opposite from the first end, and larger in thickness than the conical part.

13. The packing member according to claim 7, wherein a composition of the thermoplastic elastomer is polypropylene 40% by weight, block copolymer of polystyrene-ethylene propylene rubber-polystyrene 35% by weight, and polyethylene oil 25% by weight.

14. A packing member adapted to be removably fitted onto an olefin based amorphous polymer ink supply needle to define an ink supply passage from an ink cartridge to a recording head, the packing member is, at least partially, made of a thermoplastic elastomer containing 25% or less by weight of a polyethylene oil.

* * * * *